US010739694B2

(12) United States Patent
Kamata

(10) Patent No.: US 10,739,694 B2
(45) Date of Patent: Aug. 11, 2020

(54) IMAGE FORMING APPARATUS FOR FORMING AN IMAGE ON A RECORDING MEDIUM BY AN ELECTROPHOTOGRAPHIC METHOD

(71) Applicant: CANON KABUSHIKI KAISHA, Tokyo (JP)

(72) Inventor: Yusuke Kamata, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/512,046

(22) Filed: Jul. 15, 2019

(65) Prior Publication Data

US 2020/0033749 A1 Jan. 30, 2020

(30) Foreign Application Priority Data

Jul. 24, 2018 (JP) ..... 2018-138769

(51) Int. Cl.
*G03G 15/04* (2006.01)
*G03G 21/02* (2006.01)

(52) U.S. Cl.
CPC ..... *G03G 15/04072* (2013.01); *G03G 21/02* (2013.01); *G03G 2221/0068* (2013.01)

(58) Field of Classification Search
CPC ..... G03G 15/04072; G03G 21/02; G03G 2221/0068; G03G 21/1832; G03G 15/04; G03G 15/04036
See application file for complete search history.

(56) References Cited

U.S. PATENT DOCUMENTS

2009/0148173 A1* 6/2009 Tajima ..... G03G 15/0258 399/36
2014/0112676 A1* 4/2014 Mori ..... G03G 15/04045 399/49
2014/0334840 A1* 11/2014 Mizuno ..... F16H 55/17 399/98
2016/0033890 A1* 2/2016 Sumikura ..... G03G 15/04 347/118
2017/0277113 A1* 9/2017 Mimura ..... G03G 21/0058
2017/0371269 A1* 12/2017 Mimura ..... G03G 15/04
2018/0109693 A1* 4/2018 Watanabe ..... H04N 1/00588
2018/0314183 A1* 11/2018 Tsujioka ..... G03G 15/0409

FOREIGN PATENT DOCUMENTS

JP 2016-31467 A 3/2016

* cited by examiner

*Primary Examiner* — Sandra Brase
(74) *Attorney, Agent, or Firm* — Canon U.S.A., Inc. IP Division

(57) ABSTRACT

In a case where a cleaning member is reciprocated in a longitudinal direction of a transmissive member in cleaning operation, the time necessary for the cleaning operation is lengthened. A movement unit is controlled to move the cleaning member in a first direction from a first position in response to a cleaning start signal and then to stop the cleaning member at a second position, and to move the cleaning member in a second direction opposite to the first direction from the second position in response to a next cleaning start signal and then to stop the cleaning member at the first position.

15 Claims, 7 Drawing Sheets

IMAGE FORMING APPARATUS FOR FORMING AN IMAGE ON A RECORDING MEDIUM BY AN ELECTROPHOTOGRAPHIC METHOD

BACKGROUND OF THE INVENTION

Field of the Invention

The aspect of the embodiments relates to an image forming apparatus, such as an electrophotographic copying machine or a laser beam printer, that forms an image on a recording medium by an electrophotographic method.

Description of the Related Art

Conventionally, an image forming apparatus of an electrophotographic type is provided with an optical scanning device that irradiates an electrostatically charged surface of a photo conductor with a laser beam, to form an electrostatic latent image on the surface. The optical scanning device includes optical components, such as a light source and a mirror, a casing covering the optical components, and an opening through which light from the light source passes to the outside of the casing. The opening is covered with a transmissive member allowing the light to pass therethrough, in order to prevent foreign substances, such as toner or dust, from coming inside the casing.

In a case where there are foreign substances, such as toner or dust, on the transmissive member, the light coming through the opening is blocked by the foreign substances, thereby an optical characteristic is varied, and as a result, the quality of an image to be formed is deteriorated.

Japanese Patent Application Laid-Open No. 2016-31467 discusses cleaning processing for moving a cleaning member while keeping the cleaning member in contact with a transmissive member, so as to remove foreign substances on the transmissive member. Japanese Patent Application Laid-Open No. 2016-31467 discusses regularly performing the cleaning processing of rotating a winding motor forwards and backwards in one cleaning processing to reciprocate the cleaning member in the longitudinal direction of the transmissive member, for example, every time approximately 10,000 sheets are printed.

However, the reciprocation of the cleaning member in the cleaning processing lengthens the time necessary for the cleaning processing. As a result, subsequent image forming processing may not be immediately started. For this reason, the usability is low for a user.

SUMMARY OF THE INVENTION

According to an aspect of the embodiments, an image forming apparatus configured to form an image on a sheet includes a photo conductor, a developing unit configured to develop, with toner, an electrostatic latent image formed on the photo conductor, a scanning unit configured to scan the photo conductor with a laser beam to form the electrostatic latent image, the scanning unit including a casing, an opening formed in the casing and through which the laser beam with which the photo conductor is scanned passes from inside to outside of the casing, the opening being elongated in a scanning direction of the laser beam, a transmissive member covering the opening from outside of the casing and through which the laser beam passes, a cleaning member configured to clean a surface of the transmissive member outside the casing while being in contact with the surface of the transmissive member, a movement unit configured to move the cleaning member between a first position and a second position, the first position being a non-transmissive area of the laser beam on a first end side in a longitudinal direction of the transmissive member, the second position being a non-transmissive area of the laser beam on a second end side in the longitudinal direction of the transmissive member, the movement unit being capable of moving the cleaning member in a first direction in the longitudinal direction from the first position to the second position and in a second direction opposite to the first direction from the second position to the first position, and a control unit configured to control the movement unit to move the cleaning member in the first direction in response to a cleaning start signal and then to stop the cleaning member at the second position, and to move the cleaning member in the second direction from the second position in response to a next cleaning start signal and then to stop the cleaning member at the first position.

Further features of the disclosure will become apparent from the following description of exemplary embodiments with reference to the attached drawings.

DESCRIPTION OF THE EMBODIMENTS

An exemplary embodiment of the disclosure will be described with reference to the drawings. Unless otherwise specified, the scope of the aspect of the embodiments is not limited to, for example, the dimensions, the material, the shape, and the relative arrangement of each constituent component described below.

Figure 1:
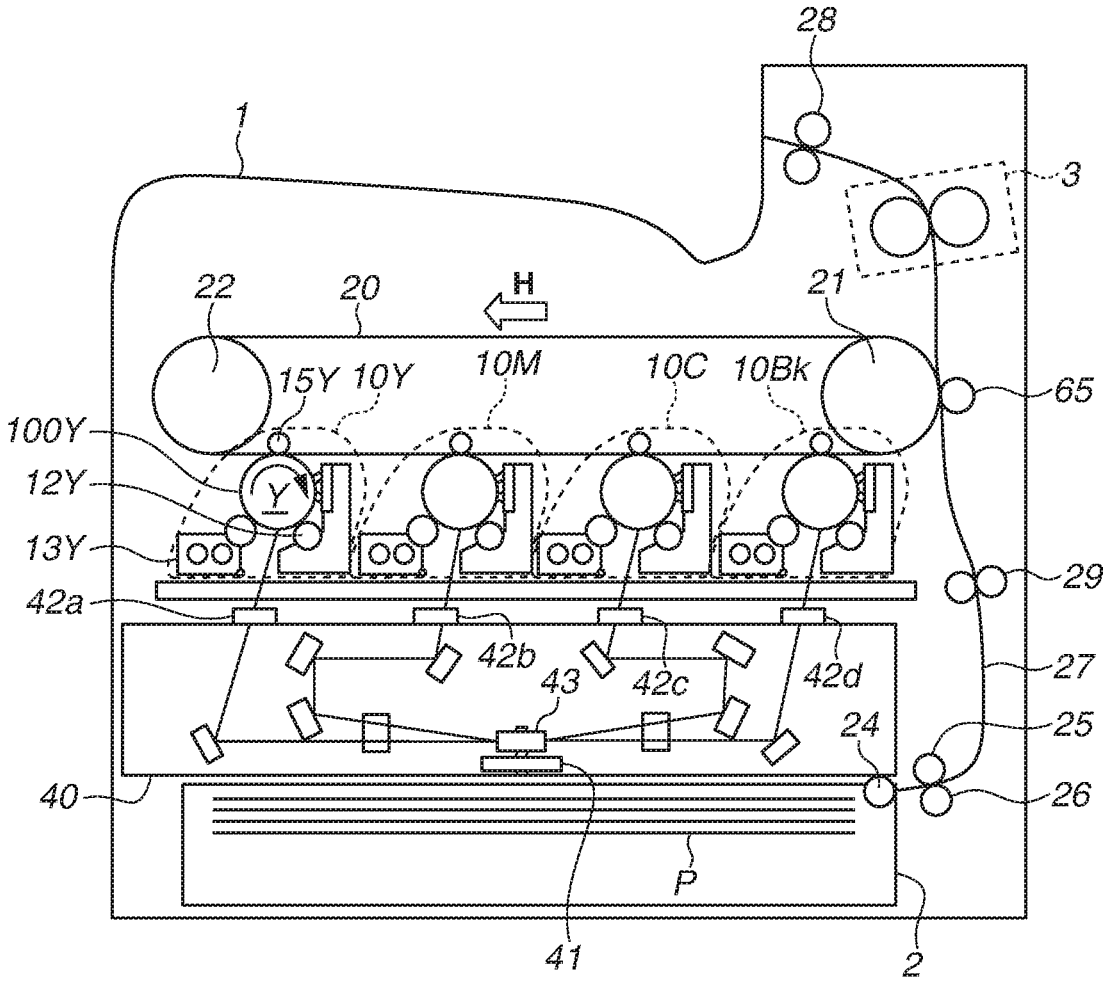
FIG. 1 is a schematic sectional view of an image forming apparatus.

FIG. 1 is a schematic sectional view of an image forming apparatus 1 according to the present exemplary embodiment. As illustrated in FIG. 1, the image forming apparatus 1 according to the present exemplary embodiment is a tandem color laser beam printer including four image-forming units 10Y, 10M, 10C, and 10Bk that form toner images in yellow (Y), magenta (M), cyan (C), and black (Bk), respectively.

The image forming apparatus 1 includes an intermediate transfer belt 20 to which the respective toner images formed by the image-forming units 10Y, 10M, 10C, and 10Bk are transferred. The respective toner images transferred onto the intermediate transfer belt 20 from the image-forming units 10 are transferred onto a sheet P that is a recoding medium, and in this way, a color image is formed on the sheet P. The image-forming units 10Y, 10M, 10C, and 10Bk are substantially the same in configuration except for the color of toner to be used. The image-forming unit 10Y will be described below as an example of the image-forming unit 10, and thus the duplicate descriptions of the image-forming units 10M, 10C, and 10Bk will be omitted.

The image-forming unit 10 includes a photo conductor 100, a charging roller 12 that electrostatically charges the photo conductor 100 at uniform background potential, a developing device 13 as a developing unit that develops an electrostatic latent image formed on the photo conductor 100 by an optical scanning device 40 to be described below, to form a toner image, and a primary transfer roller 15 that transfers the formed toner image onto the intermediate transfer belt 20. The primary transfer roller 15 and the photo conductor 100 form a primary transfer portion therebetween via the intermediate transfer belt 20. Application of a predetermined transfer voltage causes the primary transfer roller 15 to transfer the toner image formed on the photo conductor 100 onto the intermediate transfer belt 20.

The intermediate transfer belt 20 formed in an endless shape, is stretched around a first belt-conveyance roller 21 and a second belt-conveyance roller 22. The toner images formed by the image-forming units 10 are transferred onto the intermediate transfer belt 20 while the intermediate transfer belt 20 is rotationally moving in the direction of an arrow H. The four image-forming units 10Y, 10M, 10C, and 10Bk are arranged in parallel under the intermediate transfer belt 20 in the vertical direction. The toner images formed by the image-forming units 10Y, 10M, 10C, and 10Bk based on image information about the colors are transferred onto the intermediate transfer belt 20. The image-forming units 10 perform an image forming process with their colors at the timing when a toner image is to be put on a toner image that is primarily transferred onto the intermediate transfer belt 20 on an upstream side. As a result, a four-color superimposed toner image is formed on the intermediate transfer belt 20.

The first belt-conveyance roller 21 is pressed against a secondary transfer roller 65 with the intermediate transfer belt 20 therebetween. The first belt-conveyance roller 21 and the secondary transfer roller 65 form a secondary transfer portion therebetween at which the toner image is transferred onto the sheet P via the intermediate transfer belt 20. When the sheet P is conveyed through the secondary transfer portion, the toner image is transferred from the intermediate transfer belt 20 onto the sheet P. Transfer residual toner remaining on the surface of the intermediate transfer belt 20 is collected by a cleaning device not illustrated.

As for the image-forming units 10 for forming toner images in the four colors, the image-forming unit 10Y that forms a toner image in yellow, the image-forming unit 10M that forms a toner image in magenta, the image-forming unit 10C that forms a toner image in cyan, and the image-forming unit 10Bk that forms a toner image in black are arranged in this order from the upstream side of the secondary transfer portion in the rotational direction of the intermediate transfer belt 20 (direction of the arrow H).

The optical scanning device 40 is provided below the image-forming units 10 in the vertical direction. The optical scanning device 40 functions as an optical scanning unit that scans each photo conductor 100 with a laser beam and forms, on the photo conductor 100, an electrostatic latent image corresponding to image information about an image to be formed. The optical scanning device 40 is an example of the optical scanning unit.

The optical scanning device 40 includes four semiconductor lasers (not illustrated) that each emit a laser beam modulated in accordance with the image information about each of the colors. The optical scanning device 40 includes a motor unit 41 and a rotatable polygonal mirror 43. The rotatable polygonal mirror 43 is rotated at high speed by the motor unit 41 to deflect the laser beam emitted from each semiconductor laser such that the photo conductor 100 is scanned with the laser beam in the rotational axis direction of the photo conductor 100. The laser beams deflected by the rotatable polygonal mirror 43 are guided by optical members arranged inside the optical scanning device 40. Then, the laser beams are emitted from inside to outside of the optical scanning device 40 through transmissive members 42*a* to 42*d* covering openings provided at the upper portion of the optical scanning device 40. As a result, the photo conductors 100 are exposed to the respective laser beams.

Sheets P are stored in a sheet cassette 2 arranged at the lower portion of the image forming apparatus 1. A sheet P is fed by a pickup roller 24 to a separation nip portion formed by a feeding roller 25 and a retarding roller 26. The retarding roller 26 is supplied with drive so as to reverse in a case where a plurality of sheets P is fed by the pickup roller 24. In this way, the sheets P are conveyed downstream one by one, and double feeding of sheets P is prevented. The sheets P conveyed one by one by the feeding roller 25 and the retarding roller 26 are conveyed to a conveyance path 27 extending substantially vertically along the right side face of the image forming apparatus 1.

The sheet P is conveyed upwardly in the vertical direction of the image forming apparatus 1 through the conveyance path 27 to a registration roller 29. The registration roller 29 tentatively stops the sheet P being conveyed, and then corrects the skew of the sheet P. After that, the registration roller 29 conveys the sheet P to the secondary transfer portion at the timing when the toner image formed on the intermediate transfer belt 20 is conveyed to the secondary transfer portion. Thereafter, the sheet P to which the toner image is transferred at the secondary transfer portion is conveyed to a fixing unit 3. Then, the fixing unit 3 fixes the toner image on the sheet P by heating and pressing the toner image. The sheet P on which the toner image is fixed is discharged by a discharging roller 28 to a discharge tray provided at the upper portion of the main body of the image forming apparatus 1 and outside the image forming apparatus 1.

With the image-forming units 10 provided above the optical scanning device 40 inside the main body of the image forming apparatus 1, foreign substances, such as toner, paper dust, or dust, may fall onto the transmissive members 42*a* to 42*d* provided at the upper portion of the optical scanning device 40 when an image forming operation is performed. In this case, the respective laser beams emitted to the photo conductors 100 through the transmissive members 42*a* to 42*d* are blocked by the foreign substances. As a result, the optical characteristic may be changed due to the foreign substances, and the image quality may be deteriorated.

Figure 2:
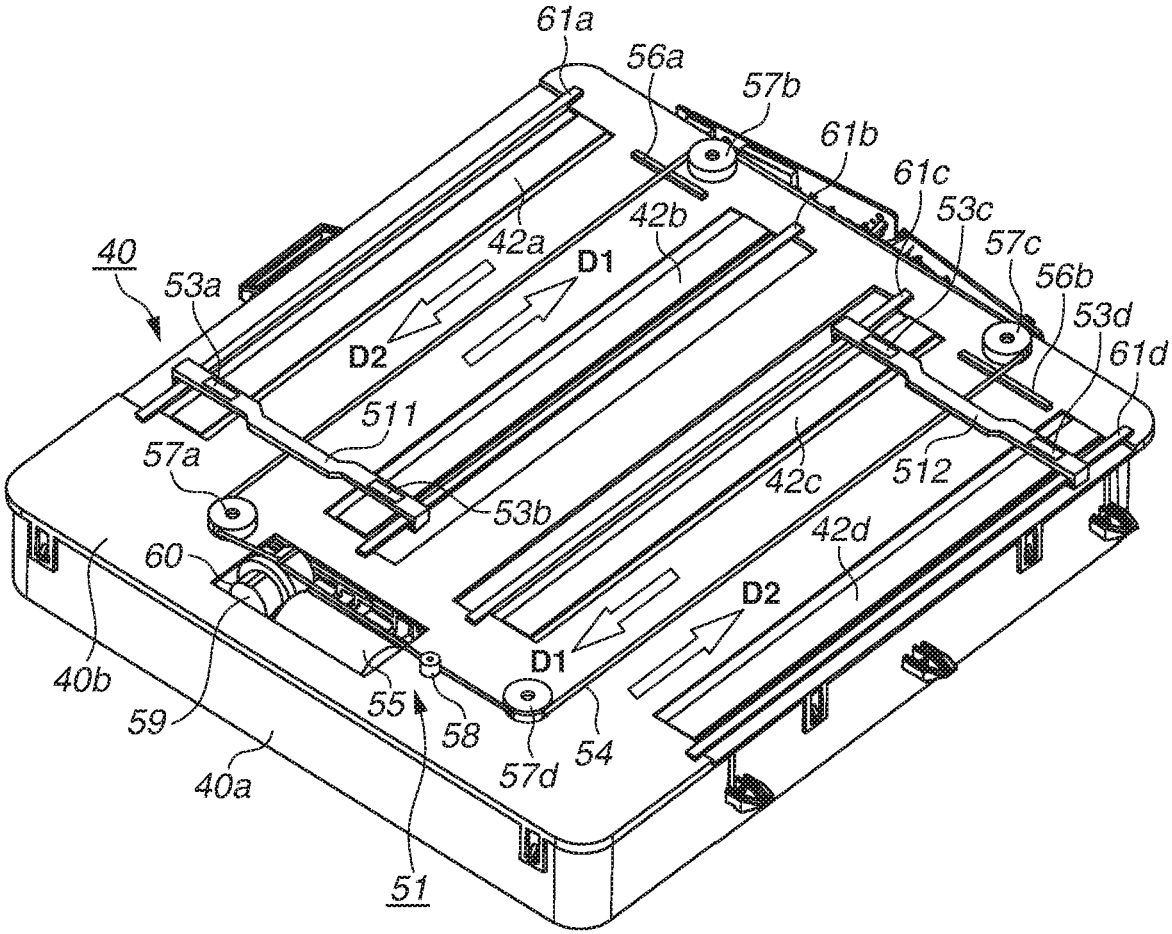
FIG. 2 is a perspective view of an optical scanning device.
Figure 3:
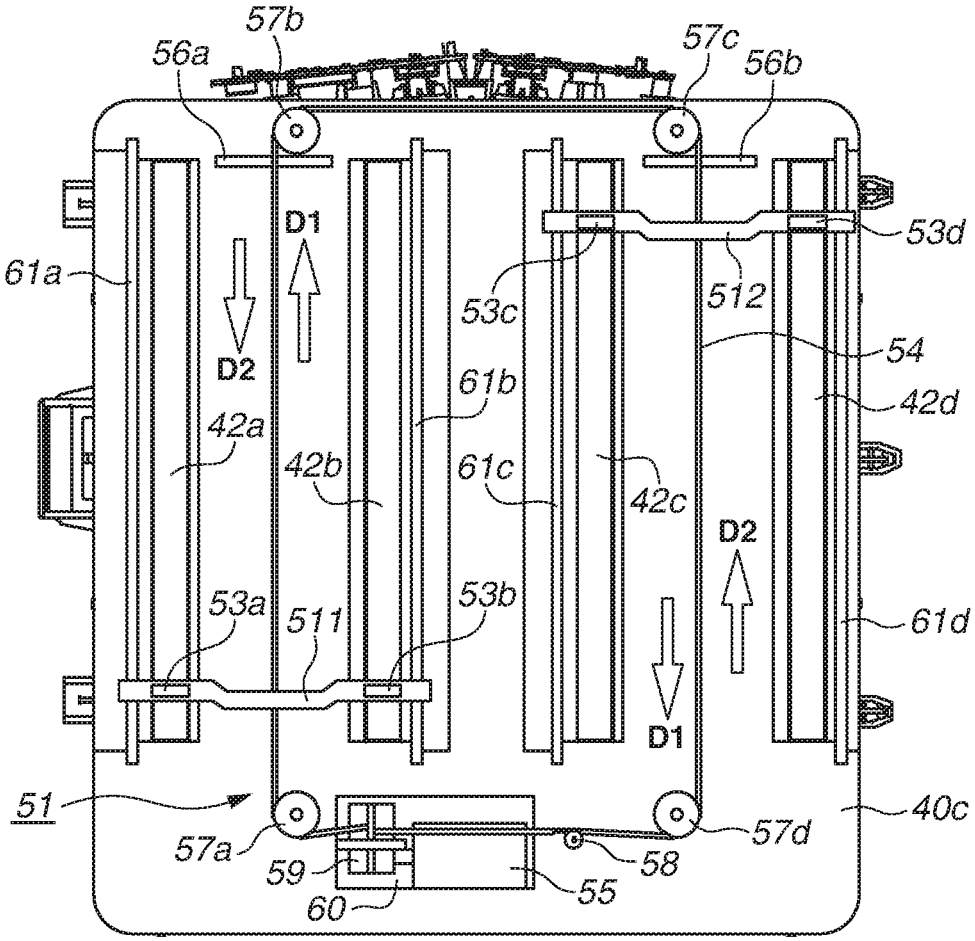
FIG. 3 is a top view of the optical scanning device.

According to the present exemplary embodiment, the optical scanning device 40 includes a cleaning mechanism 51 for cleaning the transmissive members 42*a* to 42*d*. The optical scanning device 40 and the cleaning mechanism 51 included in the optical scanning device 40 will be described in detail below. FIG. 2 is a perspective view of the entire optical scanning device 40. FIG. 3 is a top view of the optical scanning device 40.

As illustrated in FIGS. 2 and 3, the optical scanning device 40 includes a container 40*a* in which the motor unit 41 and the rotatable polygonal mirror 43 described above are stored, and a cover 40*b* attached to the container 40*a* and covering the upper face of the container 40*a*. The casing of the optical scanning device 40 is formed of the container 40*a* and the cover 40*b*. The cover 40*b* is provided with four openings through which the laser beams travel to the photo conductors 100 for the four colors. The openings each are rectangular and elongated in the rotational axis direction of the corresponding photo conductor 100. The openings longitudinally extend in parallel to each other. The openings are covered with the transmissive members 42*a* to 42*d* that each are elongated and rectangular. The transmissive members 42*a* to 42*d* that are four in number, the same as the number of the openings, are attached to the cover 40*b* such that the transmissive members 42*a* to 42*d* longitudinally extend in parallel to each other. The longitudinal direction of each of the transmissive members 42*a* to 42*d* is substantially equivalent to the scanning direction of the laser beam to be emitted from the optical scanning device 40. According to the present exemplary embodiment, the longitudinal direction of each of the transmissive members 42*a* to 42*d* is substantially equivalent to the rotational axis direction of the photo conductor 100.

The transmissive members 42*a* to 42*d* are provided in order to prevent foreign substances, such as toner, dust, or paper dust, from coming into the optical scanning device 40. Thus, the transmissive members 42*a* to 42*d* prevent deterioration in image quality due to adhesion of the foreign substances to, for example, the semiconductor lasers, the mirrors, and the rotatable polygonal mirror 43. The transmissive members 42*a* to 42*d* each are made of a transparent member, such as glass. The transmissive members 42*a* to 42*d* each allow the laser beam emitted by the semiconductor laser in the container 40*a* to travel to the photo conductor 100. According to the present exemplary embodiment, the size of each of the transmissive members 42*a* to 42*d* is set larger than the size of the opening such that the transmissive members 42*a* to 42*d* each cover the opening in such a way that the transmissive members 42*a* to 42*d* each overlap the opening. Portions of the transmissive members 42*a* to 42*d* overlapping the openings are bonded to the openings so that the transmissive members 42*a* to 42*d* are fixed to the cover 40*b*.

The optical scanning device 40 is covered with the cover 40*b* and the transmissive members 42*a* to 42*d*, so that foreign substances, such as toner, paper dust, or dust, are prevented from coming into the optical scanning device 40. The transmissive members 42*a* to 42*d* larger than the openings are bonded and fixed to the cover 40*b*. As a result, foreign substances, such as toner, paper dust, or dust, falling from above the optical scanning device 40 are prevented from coming into the optical scanning device 40 through the gaps between the transmissive members 42*a* to 42*d* and the respective openings.

According to the present exemplary embodiment, the image forming apparatus incudes the cleaning mechanism 51 that performs cleaning processing of removing foreign substances falling down onto the upper face of the optical scanning device 40 (upper faces of the transmissive members 42*a* to 42*d*). The upper faces of the transmissive members 42*a* to 42*d* face outward with respect to the optical scanning device 40, and the laser beams passing through the transmissive members 42*a* to 42*d* travel to outside from the upper faces of the transmissive members 42*a* to 42*d*.

The cleaning mechanism 51 is attached on the cover 40*b* of the optical scanning device 40 such that the cleaning mechanism 51 is opposed to the image-forming units 10. The cleaning mechanism 51 includes cleaning members 53*a* to 53*d* for cleaning the upper faces of the transmissive members 42*a* to 42*d* (outer face of the optical scanning device 40), respectively, a first cleaning holder 511 that holds and moves the cleaning member 53*a* and 53*b* on the transmissive members 42*a* and 42*b*, and a second cleaning holder 512 that holds and moves the cleaning member 53*c* and 53*d* on the transmissive members 42*c* and 42*d*.

The first cleaning holder 511 and the second cleaning holder 512 each extend astride the adjacent two transmissive members 42 in a direction orthogonal to the direction in which the transmissive members 42 extend. The first cleaning holder 511 and the second cleaning holder 512 each hold two cleaning members 53. The number of cleaning members 53 held by each of the first cleaning holder 511 and the second cleaning holder 512 corresponds to the number of the transmissive members 42.

The first cleaning holder 511 arranged astride the transmissive members 42*a* and 42*b* includes the cleaning member 53*a* that cleans the upper face of the transmissive member 42*a* and the cleaning member 53*b* that cleans the upper face of the transmissive member 42*b*. The second cleaning holder 512 arranged astride the transmissive members 42*c* and 42*d* includes the cleaning member 53*c* that cleans the upper face of the transmissive member 42*c* and the cleaning member 53*d* that cleans the upper face of the transmissive member 42*d*.

The cleaning members 53*a* to 53*d* made of silicon rubber or unwoven fabric are moved in contact with the upper faces of the transmissive members 42 together with movement of the first cleaning holder 511 and the second cleaning holder 512. In this way, the cleaning members 53*a* to 53*d* can remove the foreign substances on the transmissive members 42 and clean the transmissive members 42.

The first cleaning holder 511 having a central portion coupled to a wire 54 holds the cleaning members 53*a* and 53*b* on both end sides of the first cleaning holder 511 with the wire 54 as a center. The second cleaning holder 512 having a central portion coupled to the wire 54 holds the cleaning members 53*c* and 53*d* on both end sides of the second cleaning holder 512 with the wire 54 as a center. Therefore, the wire 54 is stretched such that the wire 54 passes between the transmissive members 42*a* and 42*b* and between the transmissive members 42*c* and 42*d*.

The wire 54 is stretched annularly on the cover 40*b* by four stretcher pulleys 57*a* to 57*d* rotatably disposed on the cover 40*b*, a tension adjustment pulley 58, and a winding drum 59. The wire 54 is stretched around the stretcher pulleys 57*a* to 57*d* with the length of the wire 54 adjusted by a predetermined number of windings with the winding drum 59 when the device is assembled. In this case, the four stretcher pulleys 57*a* to 57*d* are arranged such that the wire 54 passes between the transmissive members 42*a* and 42*b* and between the transmissive members 42*c* and 42*d*, as described above.

Because the tensile force of the wire 54 is adjusted by the tension adjustment pulley 58 provided between the stretcher pulleys 57*a* and 57*d*, the wire 54 stretched with no slack is arranged between the stretcher pulleys 57, the tension adjustment pulley 58, and the winding drum 59. This arrangement enables the wire 54 to run annularly smoothly while the wire 54 is stretched.

According to the present exemplary embodiment, the tension adjustment pulley 58 is provided between the stretcher pulleys 57*a* and 57*d*, but the position of the tension adjustment pulley 58 is not limited to this position as long as the tensile force of the wire 54 stretched around the stretcher pulleys 57*a* to 57*d* can be adjusted.

According to the present exemplary embodiment, the first cleaning holder 511 is provided with the cleaning members 53*a* and 53*b*, and the second cleaning holder 512 is provided with the cleaning members 53*c* and 53*d*. In contrast to this, in a case where one cleaning holder holds one cleaning member, the same number of cleaning holders as the number of transmissive members are to be provided, and as a result, the length of a wire to be stretched for the cleaning holders is increased. For this reason, according to the present exemplary embodiment, the number of cleaning holders can be reduced and the length of the wire 54 can be shortened in comparison to the configuration in which one cleaning holder holds one cleaning member. In this way, the upper faces of the transmissive members 42*a* to 42*d* can be cleaned with a simplified configuration.

The winding drum 59 is rotatable due to the drive of a winding motor 55 as a drive unit.

The winding motor 55 is rotatable forward and backward. According to the present exemplary embodiment, the forward rotation and the backward rotation of the winding motor 55 are defined as a clockwise (CW) direction and a counterclockwise (CCW) direction, respectively.

Therefore, rotation of the winding drum 59 due to rotation in the CW direction or the CCW direction of the winding motor 55 causes the winding drum 59 to wind up or wind down the wire 54. The wire 54 is wound up or down by the winding drum 59 in this manner so that the wire 54 that has been stretched around the stretcher pulleys 57 runs annularly on the cover 40*b*.

Accordingly, the first cleaning holder 511 and the second cleaning holder 512 coupled to the wire 54 each are capable of moving in the directions of arrows D1 and D2 (longitudinal directions of the transmissive members 42) together with running of the wire 54. According to the present exemplary embodiment, when the winding motor 55 is rotated in the CCW direction, each of the first cleaning holder 511 and the second cleaning holder 512 is moved in the direction of the arrow D1. When the winding motor 55 is rotated in the CW direction, each of the first cleaning holder 511 and the second cleaning holder 512 is moved in the direction of the arrow D2. The wire 54, the stretcher pulleys 57*a* and 57*d*, the tension adjustment pulley 58, and the winding drum 59 are an example of a movement unit. The winding motor 55 is an example of a drive motor.

In this case, because the wire 54 is annularly stretched, the first cleaning holder 511 and the second cleaning holder 512 are linearly moved in directions opposite to each other in the longitudinal directions of the transmissive members 42*a* to 42*d*, together with movement of the wire 54. The direction of the arrow D1 is an example of the first direction, and the direction of the arrow D2 is an example of the second direction.

The winding motor 55 and the winding drum 59 are provided in a recess 60 recessed in the upper face of the cover 40*b*. This arrangement enables reduction of the size in the height direction of the optical scanning device 40. The recess 60 is not in communication with the inside of the optical scanning device 40, and for this reason, no foreign substance comes inside the optical scanning device 40 through the recess 60.

The cover 40*b* is provided with a first stopper 56*a* that regulates movement of the first cleaning holder 511 in the longitudinal directions of the transmissive members 42*a* and 42*b* (rotational axis directions of the photo conductors 100). The cover 40*b* is provided with a second stopper 56*b* that regulates movement of the second cleaning holder 512 in the longitudinal directions of the transmissive members 42*c* and 42*d* (rotational axis directions of the photo conductors 100). The first stopper 56*a* and the second stopper 56*b* each are examples of a contact member.

The first stopper 56*a* and the second stopper 56*b* are provided on one end side in the longitudinal directions of the transmissive members 42*a* to 42*d*. In this way, when the first cleaning holder 511 and the second cleaning holder 512 are each moved in the direction of the arrow D1, the first cleaning holder 511 arrives at the ends of the transmissive members 42*a* and 42*b* in the direction of the arrow D1, and comes into contact with the first stopper 56*a*.

As described above, the first stopper 56*a* regulates movement of the first cleaning holder 511 in the direction of the arrow D1, and the load acting on the winding motor 55 rotating the winding drum 59 to cause the wire 54 to run is increased. Detection of the load with an electric current detection unit to be described below enables detection of the first cleaning holder 511 that has arrived at the first stopper 56*a* (first position of the first cleaning holder 511 on the one end side in the longitudinal directions of the transmissive members 42). In this case, the second cleaning holder 512 is located opposite to the first cleaning holder 511 in the longitudinal directions of the transmissive members 42.

When the winding motor 55 is driven to rotate in the CW direction, the wire 54 runs in the direction of the arrow D2, so that the first cleaning holder 511 and the second cleaning holder 512 are each moved in the direction of the arrow D2.

Then, the second cleaning holder 512 arrives at the ends of the transmissive members 42*c* and 42*d* in the direction of the arrow D2, and comes into contact with the second stopper 56*b*.

As described above, the second stopper 56*b* regulates movement of the second cleaning holder 512 in the direction of the arrow D2, and the load acting on the winding motor 55 rotating the winding drum 59 to cause the wire 54 to run is increased. Detection of the load with the electric current detection unit to be described below enables detection of the second cleaning holder 512 that has arrived at the second stopper 56*b*. In this case, the first cleaning holder 511 is located opposite to the second cleaning holder 512 in the longitudinal directions of the transmissive members 42.

In this manner, according to the present exemplary embodiment, detection of the drive current of the winding motor 55 enables detection of the first cleaning holder 511 that has arrived at the first stopper 56*a* or detection of the second cleaning holder 512 that has arrived at the second stopper 56*b*.

In a case where it is detected that the first cleaning holder 511 has arrived at the first stopper 56*a* or it is detected that the second cleaning holder 512 has arrived at the second stopper 56*b*, the winding motor 55 stops rotating.

According to the present exemplary embodiment, movement of the first cleaning holder 511 from one end side to the other end side on the transmissive members 42*a* and 42*b* and movement of the second cleaning holder 512 from one end side to the other end side on the transmissive members 42*c* and 42*d* are defined as a series of cleaning operation. After a series of cleaning operation finishes, information about the next movement direction is stored in a random access memory (RAM) 503 to be described below (refer to FIG. 6) so that it can be determined whether the first cleaning holder 511 and the second cleaning holder 512 are to be moved in the direction of the arrow D1 or in the direction of the arrow D2.

The position at which the first cleaning holder 511 comes into contact with the first stopper 56*a* and the position at which the second cleaning holder 512 comes into contact with the second stopper 56*b* each are identical to a non-transmissive area through which no laser beams pass in the transmissive members 42. The stop position of each of the first cleaning holder 511 and the second cleaning holder 512 when the cleaning operation finishes is a normal stop position, namely, a cleaning start position.

According to the present exemplary embodiment, the winding motor 55 rotates forward to cause the wire 54 to run in the direction of the arrow D2, and rotates backward to cause the wire 54 to run in the direction of the arrow D1. However, the winding motor 55 may rotate forward to cause the wire 54 to run in the direction of the arrow D1, and rotate backward to cause the wire 54 to run in the direction of the arrow D2.

Figure 4:
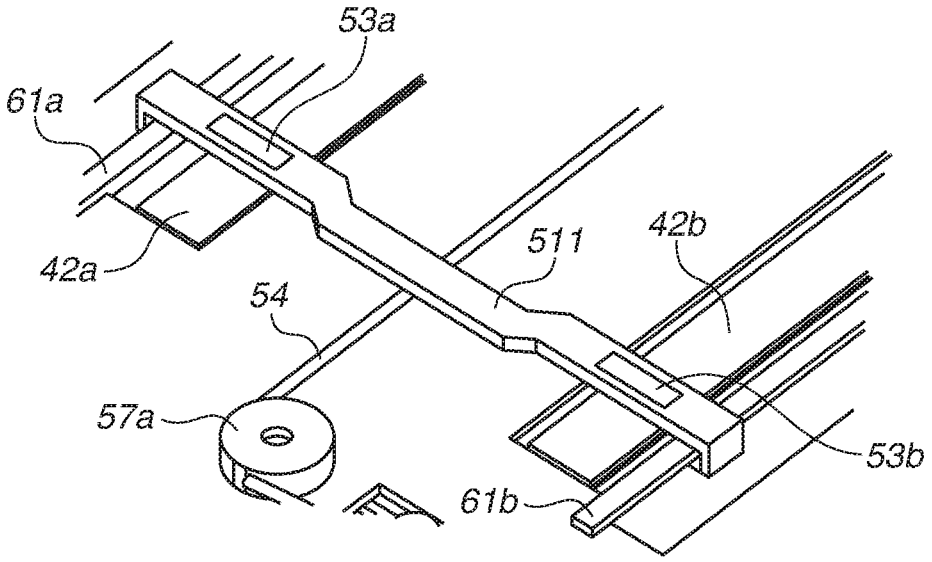
FIG. 4 is a partial perspective view of a first cleaning holder.
Figure 5:
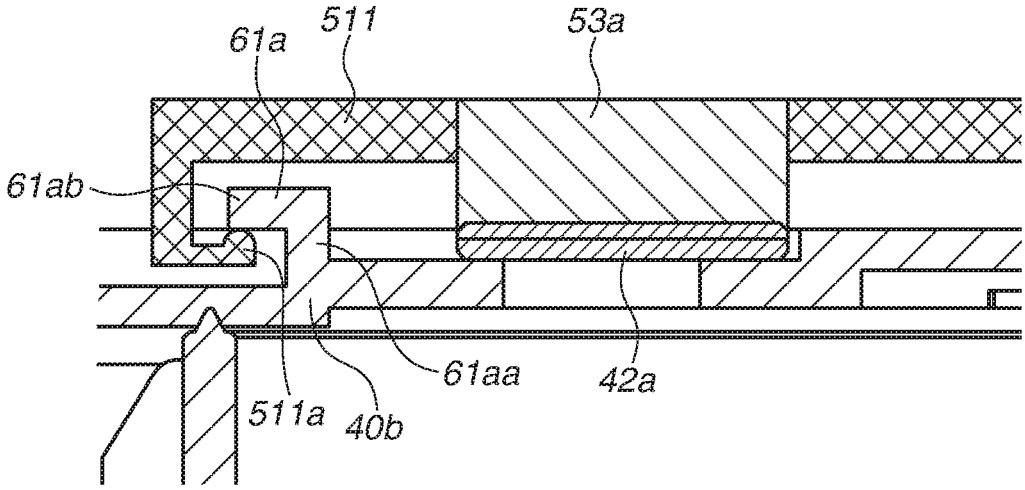
FIG. 5 is a partial sectional view of the first cleaning holder.

The cover 40*b* is provided with guide members 61*a* and 61*b* for guiding the first cleaning holder 511 and guide members 61*c* and 61*d* for guiding the second cleaning holder 512. As illustrated in FIGS. 4 and 5, the ends of the first cleaning holder 511 are engaged with the guide members 61*a* and 61*b*.

FIG. 4 is a partial perspective view of an area around the first cleaning holder 511. The ends of the second cleaning holder 512, similar in configuration to those of the first cleaning holder 511, are engaged with the guide members 61*c* and 61*d*. FIG. 5 is a partial sectional view of the end on the side on which the cleaning member 53*a* is held in the longitudinal direction of the first cleaning holder 511. Although only the configuration of the first cleaning holder 511 will be described below, the second cleaning holder 512 has a similar configuration, according to the present exemplary embodiment.

As illustrated in FIGS. 4 and 5, the guide members 61*a* and 61*b* integrally formed with the cover 40*b* protrude upward from the upper face of the cover 40*b*.

As illustrated in FIG. 5, the guide member 61*a* includes a first protrusion 61*aa* protruding upward from the upper face of the cover 40*b* and a second protrusion 61*ab* extending from the first protrusion 61*aa* farther away from the cleaning member 53*a*.

An end 511*a* on one end side of the first cleaning holder 511 is fit underneath the second protrusion 61*ab*. The end 511*a* has an arc-shaped portion in contact with the second protrusion 61*ab*. In this way, the arc shape of the end 511*a* can reduce slide resistance when the first cleaning holder 511 is moved in the direction of the arrow D1 or in the direction of the arrow D2 (refer to FIG. 3).

According to the present exemplary embodiment, although only the one end side of the first cleaning holder 511 will be described in detail, the other end side is similar in configuration to the one end side. The second cleaning holder 512 is similar in shape to the first cleaning holder 511.

The first cleaning holder 511 is engaged with the guide members 61*a* and 61*b* so that the cleaning members 53*a* and 53*b* held by the first cleaning holder 511 are not moved apart from the transmissive members 42*a* and 42*b*. The second cleaning holder 512 is engaged with the guide members 61*c* and 61*d* so that the cleaning members 53*c* and 53*d* held by the second cleaning holder 512 are not moved apart from the transmissive members 42*c* and 42*d*. In this case, the first cleaning holder 511 is engaged with the guide members 61*a* and 61*b* at a position where the cleaning members 53*a* and 53*b* are in contact with the transmissive members 42*a* and 42*b* at a predetermined contact pressure. The second cleaning holder 512 is engaged with the guide members 61*c* and 61*d* at a position where the cleaning members 53*c* and 53*d* are in contact with the transmissive members 42*c* and 42*d* at a predetermined contact pressure.

According to the present exemplary embodiment, the guide members 61*a* to 61*d*, the first stopper 56*a*, and the second stopper 56*b* are formed of resin and integrated with the cover 40*b*. However, the guide members 61*a* to 61*d*, the first stopper 56*a*, and the second stopper 56*b* may be formed separately from the cover 40*b*.

As described above, according to the present exemplary embodiment, the first cleaning holder 511 and the second cleaning holder 512 are moved in the direction of the arrow D1 or in the direction of the arrow D2 in cleaning operation so as to clean the upper faces of the transmissive members 42*a* to 42*d*.

Conventionally, for such a cleaning operation on the transmissive members 42*a* to 42*d*, reciprocation of the first cleaning holder 511 and the second cleaning holder 512 has been defined as one flow of cleaning operation. In other words, in response to a cleaning start signal for one time, the first cleaning holder 511 reciprocates on the transmissive members 42*a* and 42*b* and the second cleaning holder 512 reciprocates on the transmissive members 42*c* and 42*d*.

However, in a case where the reciprocation of each of the first cleaning holder 511 and the second cleaning holder 512 is defined as one flow of cleaning operation, the time necessary for the cleaning operation is lengthened. In a case where an image forming job has been accepted from a user, there is a possibility that the waiting time of the user is lengthened.

According to the present exemplary embodiment, in the cleaning operation, the first cleaning holder 511 and the second cleaning holder 512 are moved only either in the direction of the arrow D1 or in the direction of the arrow D2 to make the time necessary for the cleaning operation shorter than ever before.

Figure 6:
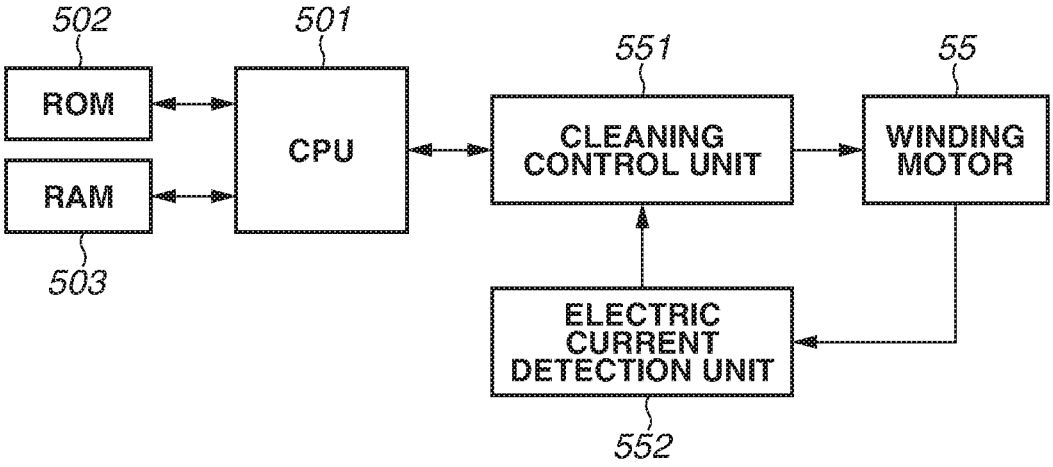
FIG. 6 is a control block diagram for performing position determination processing according to a first exemplary embodiment.
Figure 7:
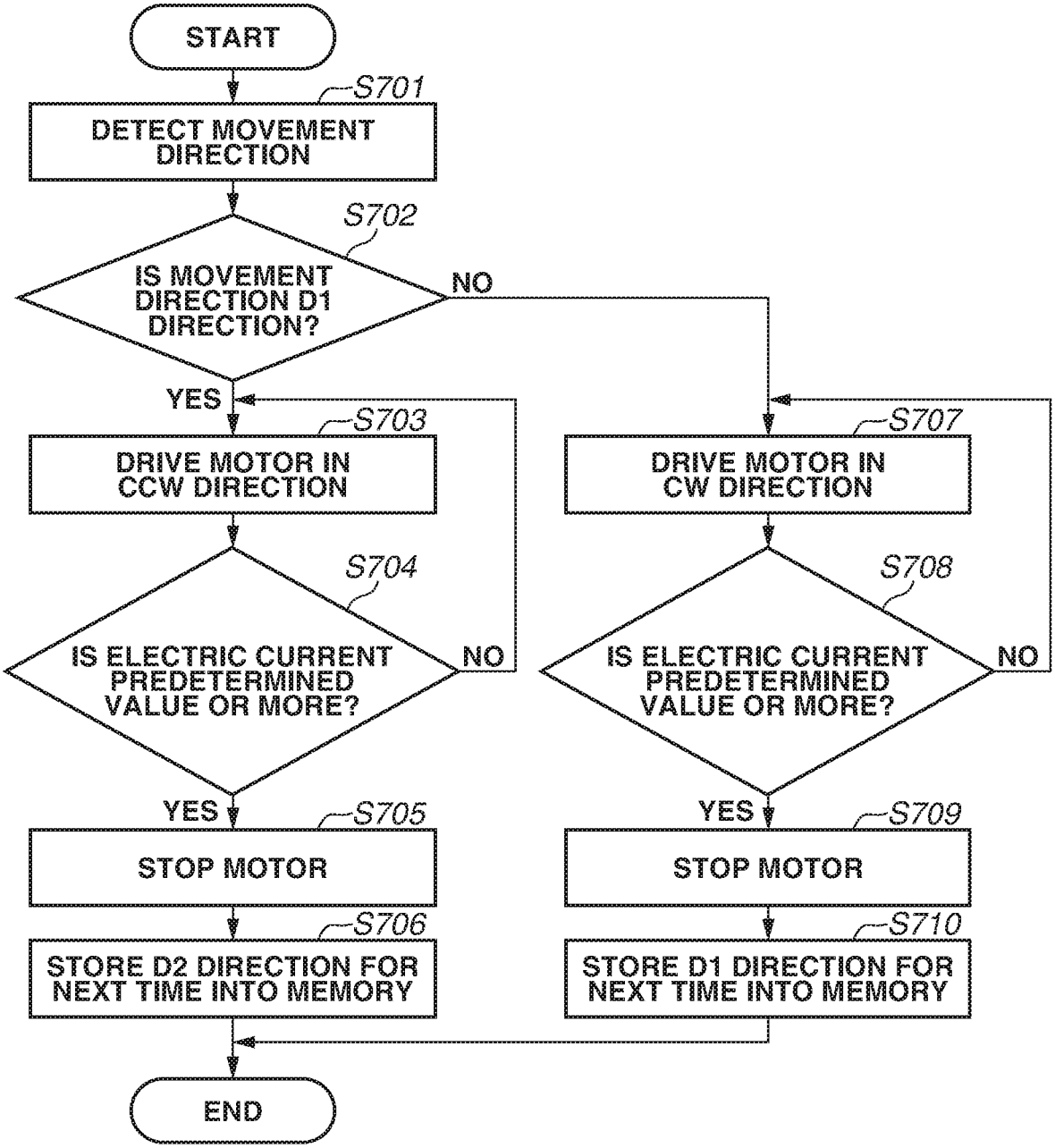
FIG. 7 is a flowchart of the position determination processing according to the first exemplary embodiment.

The cleaning operation of the first cleaning holder 511 and the second cleaning holder 512 according to the present exemplary embodiment will be described. FIG. 6 is a control block diagram of a control configuration for performing the cleaning operation according to the present exemplary embodiment. FIG. 7 is a flowchart of the cleaning operation according to the present exemplary embodiment.

FIG. 6 illustrates a central processing unit (CPU) 501 that controls the entire image forming apparatus 1 and performs control in the cleaning operation of the first cleaning holder 511 and the second cleaning holder 512.

The CPU 501 reads a firmware program and a boot program for controlling the firmware program stored in a read only memory (ROM) 502, and performs various types of control using the RAM 503 as a work area and a primary storage area for data. The RAM 503 stores the movement direction of the first cleaning holder 511 and the second cleaning holder 512 as described above.

The CPU 501 outputs, for example, an execution instruction for the cleaning operation to a cleaning control unit 551 in order to control the winding motor 55. The cleaning control unit 551 drives the winding motor 55 to rotate in the CW direction or in the CCW direction on the basis of the execution instruction for the cleaning operation. In other words, the CPU 501 controls the winding motor 55 in the cleaning operation via the cleaning control unit 551.

The electric current detection unit 552 detects the drive current of the winding motor 55 as described above, and outputs a result of the detection to the cleaning control unit 551. The cleaning control unit 551 operates the winding motor 55 to rotate in the CW direction or the CCW direction or stops the winding motor 55 in response to an instruction from the CPU 501 based on the result of the detection performed by the electric current detection unit 552.

As described above, the CPU 501 determines that the first cleaning holder 511 has come into contact with the first stopper 56*a* or that the second cleaning holder 512 has come into contact with the second stopper 56*b* on the basis of the result of the detection of the electric current detection unit 552.

The winding motor 55 is controlled at a constant voltage. When the first cleaning holder 511 comes into contact with the first stopper 56*a* or when the second cleaning holder 512 comes into contact with the second stopper 56*b*, the drive current of the winding motor 55 is increased as the load acting on the winding motor 55 is increased.

Therefore, in a case where the value of the drive current of the winding motor 55 detected by the electric current detection unit 552 is larger than a predetermined value, the cleaning control unit 551 detects that the first cleaning holder 511 has come into contact with the first stopper 56*a* or that the second cleaning holder 512 has come into contact with the second stopper 56*b* and that one-way movement has been finished from one end to the other end of each of the transmissive members 42*a* to 42*d*. In other words, the cleaning control unit 551 detects that the cleaning operation has been finished.

The predetermined value is larger than the value of the drive current flowing in the winding motor 55 during movement of the first cleaning holder 511 and the second cleaning holder 512 on the transmissive members 42. In other words, the predetermined value is larger than the value of the drive current flowing in the winding motor 55 before the first cleaning holder 511 comes into contact with the first stopper 56*a* or the second cleaning holder 512 comes into contact with the second stopper 56*b*. The predetermined value enables detection of the first cleaning holder 511 that has come into contact with the first stopper 56*a* or detection of the second cleaning holder 512 that has come into contact with the second stopper 56*b*. Thus, the predetermined value does not include the value of electric current that is increased due to other variation, such as motor failure.

According to the present exemplary embodiment, whether the first cleaning holder 511 has come into contact with the first stopper 56*a* or the second cleaning holder 512 has come into contact with the second stopper 56*b* is determined based on comparison between the value of the detected electric current and the predetermined value, but it may be determined by another method. For example, whether the first cleaning holder 511 has come into contact with the first stopper 56*a* or the second cleaning holder 512 has come into contact with the second stopper 56*b* may be determined based on determination of an amount of variation in the value of the detected electric current, instead of the comparison between the detected electric current and the predetermined value. In this case, the amount of variation in the value of electric current before and after the first cleaning holder 511 comes into contact with the first stopper 56*a* or the second cleaning holder 512 comes into contact with the second stopper 56*b* is larger than the amount of variation in the value of electric current during movement of the first cleaning holder 511 and the second cleaning holder 512 on the transmissive members 42*a* to 42*d*. Therefore, detection of the variation in the value of electric current enables detection of the first cleaning holder 511 that has come into contact with the first stopper 56*a* or detection of the second cleaning holder 512 that has come into contact with the second stopper 56*b*.

According to the present exemplary embodiment, the CPU 501 controls the winding motor 55 via the cleaning control unit 551, but the CPU 501 may directly control, for example, the winding motor 55 without using the cleaning control unit 551.

The control that the CPU 501 performs via the cleaning control unit 551 in position determination processing according to the present exemplary embodiment will be described with FIG. 7.

First, in step S701, the CPU 501 detects the movement direction of the first cleaning holder 511 and the second cleaning holder 512 from the RAM 503, in response to the cleaning start signal for starting the cleaning operation.

Next, in step S702, the CPU 501 determines whether the movement direction is the direction of the arrow D1. In a case where the movement direction of the first cleaning holder 511 and the second cleaning holder 512 is the direction of the arrow D1 (Yes in step S702), the CPU 501 outputs a signal to the cleaning control unit 551 so that the winding motor 55 rotates in the CCW direction in step S703.

After that, in step S704, the CPU 501 determines whether the value of the drive current detected by the electric current detection unit 552 is the predetermined value or more. In a case where the value of the drive current is the predetermined value or more (Yes in step S704), the CPU 501 outputs a signal to the cleaning control unit 551 so that the winding motor 55 stops rotating in step S705. In a case where the value of the drive current is less than the predetermined value (No in step S704), the CPU 501 causes the winding motor 55 to continue rotating in the CCW direction.

In step S706, the CPU 501 stores, into the RAM 503, data indicating that the movement direction of the first cleaning holder 511 and the second cleaning holder 512 for the next cleaning operation is the direction of the arrow D2, and finishes the cleaning operation.

In step S702, in a case where the movement direction of the first cleaning holder 511 and the second cleaning holder 512 is the direction of the arrow D2 (No in step S702), the CPU 501 outputs a signal to the cleaning control unit 551 so that the winding motor 55 rotates in the CW direction (step S707).

After that, in step S708, the CPU 501 determines whether the value of the drive current detected by the electric current detection unit 552 is the predetermined value or more. In a case where the value of the drive current is the predetermined value or more (Yes in step S708), the CPU 501 outputs a signal to the cleaning control unit 551 so that the winding motor 55 stops rotating in step S709. In a case where the value of the drive current is less than the predetermined value (No in step S708), the CPU 501 causes the winding motor 55 to continue rotating in the CW direction.

In step S710, the CPU 501 stores, into the RAM 503, data indicating that the movement direction of the first cleaning holder 511 and the second cleaning holder 512 for the next cleaning operation is the direction of the arrow D1, and finishes the cleaning operation.

According to the present exemplary embodiment described above, in step S706 or step S710, the movement direction for the next cleaning operation is stored in the RAM 503. However, in step S703 or step S707, the direction in which the winding motor 55 is driven may be stored in the RAM 503. In a case where the direction is stored in step S703 or step S707, the winding motor 55 is controlled in step S702 such that the first cleaning holder 511 and the second cleaning holder 512 are moved in the directions opposite to their movement directions in the previous cleaning operation stored in the RAM 503. In step S706 or step S710, the stop position or the cleaning start position of each of the first cleaning holder 511 and the second cleaning holder 513 when the cleaning operation is finished may be stored into the RAM 503 so that the movement directions in response to the next cleaning start signal are determined.

According to the present exemplary embodiment, the cleaning start signal for starting the cleaning operation is generated by the CPU 501 in a case where the number of sheets subjected to image forming or the number of discharged sheets counted by a counter (not illustrated) reaches a predetermined number of sheets. In response to the generated cleaning start signal, the CPU 501 performs the control according to the flowchart illustrated in FIG. 7. In a case where the cleaning start signal is generated while an image forming job is being processed, the CPU 501 controls the image forming apparatus 1 to temporarily stop the image forming job and to resume the image forming job after the cleaning operation is performed. The timing when the cleaning start signal is generated according to the present exemplary embodiment is not limited to the above timing. The cleaning start signal may be generated in a case where, for example, an operation unit (not illustrated) accepts an instruction for starting the cleaning operation from an operator at an arbitrary timing. The cleaning start signal may be generated by a different control module instead of the CPU 501.

According to the present exemplary embodiment, the drive current of the winding motor 55 is detected at any time. However, the electric current may be detected after the elapse of a predetermined amount of time after the winding motor 55 is driven to rotate.

As described above, according to the present exemplary embodiment, the first cleaning holder 511 and the second cleaning holder 512 are each moved only either in the direction of the arrow D1 or in the direction of the arrow D2 in the cleaning operation in response to the cleaning start signal for one time. For this reason, the time necessary for the cleaning operation can be made shorter than ever before. Even in a case where an instruction for starting the cleaning operation is accepted from the user, the waiting time of the image forming job can be shortened, and the usability can be improved.

According to the exemplary embodiment described above, the optical scanning device 40 is provided below the image-forming units 10 in the vertical direction. However, the optical scanning device 40 may be provided above the image-forming units 10 in the vertical direction. In a case where the optical scanning device 40 is provided above the image-forming units 10 in the vertical direction, no toner or no paper dust falls from the image-forming units 10 because the transmissive members 42*a* to 42*d* are provided above the image-forming units 10. However, there is a possibility that scattered toner or paper dust adheres to the transmissive members 42*a* to 42*d*. For this reason, even in a case where the optical scanning device 40 is provided above the image-forming units 10 in the vertical direction, the cleaning mechanism 51 is provided so as to remove foreign substances, such as toner or paper dust, present on the transmissive members 42*a* to 42*d*.

According to the exemplary embodiment described above, the first cleaning holder 511 that has arrived at the first stopper 56*a* or the second cleaning holder 512 that has arrived at the second stopper 56*b* is detected on the basis of the value of the drive current of the winding motor 55 larger than the predetermined value. However, a position detecting sensor may be provided at each cleaning finish position of the first cleaning holder 511 or the second cleaning holder 512 (on each end side in the longitudinal directions of the transmissive members 42). In a case where the position detecting sensor is provided, it can be detected whether the first cleaning holder 511 or the second cleaning holder 512 has arrived at the cleaning finish position on the end side in the longitudinal directions of the transmissive members 42 on the basis of detection of the first cleaning holder 511 or the second cleaning holder 512 by the position detecting sensor. In this way, a result of detection of the position of the first cleaning holder 511 or the second cleaning holder 512 is stored into the RAM 503 so that the movement direction in response to the next cleaning start signal can be determined.

According to the exemplary embodiment of the disclosure, the time necessary for the cleaning operation can be made shorter than ever before.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-138769, filed Jul. 24, 2018, which is hereby incorporated by reference herein in its entirety.

What is claimed is:

1. An image forming apparatus configured to form an image on a sheet, the image forming apparatus comprising:

a photosensitive drum;

a scanning unit configured to scan the photosensitive drum with a laser beam to expose the photosensitive drum, the scanning unit comprising:

a light source configured to emit the laser beam;

a casing configured to contain a deflector and an optical member, the deflector being configured to deflect the laser beam emitted from the light source, the optical member being configured to guide, toward the photosensitive drum, the laser beam deflected by the deflector;

an opening that is elongated and formed in the casing so as to cause the laser beam to pass from inside to outside of the casing;

a transmissive member covering the opening from outside of the casing and through which the laser beam passes, the transmissive member having a light passing area that is an area where the laser beam to be used for exposing the photosensitive drum passes;

a cleaning member configured to clean a surface of the transmissive member outside the casing while being in contact with the surface of the transmissive member;

a holding member configured to hold the cleaning member outside the casing;

a moving mechanism configured to move the holding member to a first area that is an area outside the light passing area in a longitudinal direction of the transmissive member and to a second area that is an area outside the light passing area in the longitudinal direction and is opposite of the first area with respect to the light passing area in the longitudinal direction, wherein the cleaning member is located in the first area in a state where the holding member is stopped at the first area and the cleaning member is located in the second area in a state where the holding member is stopped at the second area; and a control unit configured to control the scanning unit and the moving mechanism, wherein the control unit allows the scanning unit to expose the photosensitive drum in a state where the holding member is stopped at the first area;

causes the moving mechanism to move the holding member from the first area to the second area in response to a cleaning start signal;

allows the scanning unit to expose the photosensitive drum in a state where the holding member is stopped at the second area; and causes the moving mechanism to move the holding member from the second area to the first area in response to a next cleaning start signal.

2. The image forming apparatus according to claim 1, further comprising a storage unit configured to store information indicating whether a movement direction in which the movement unit moves the holding member is the first direction, in which the cleaning member and the holding member move from the first area toward the second area, or the second direction, which is opposite of the first direction.

3. The image forming apparatus according to claim 2, wherein the control unit controls the movement unit to move the holding member in a direction different from either the first direction or the second direction that is stored in the storage unit as a last movement direction, in response to a holding start signal.

4. The image forming apparatus according to claim 1, further comprising a storage unit configured to store a stop position of the holding member.

5. The image forming apparatus according to claim 4, wherein the control unit controls the movement unit to move the holding member in the first direction in response to a cleaning start signal in a case where the stop position of the holding member stored in the storage unit is a position of the holding member that is in a state of being stopped at the first area, and controls the movement unit to move the holding member in the second direction in response to the cleaning start signal in a case where the stop position of the holding member stored in the storage unit is a position of the holding member that is in a state of being stopped at the second area.

6. The image forming apparatus according to claim 1, further comprising a counter unit configured to count a number of times the apparatus performs an image forming operation to form an image on a sheet.

7. The image forming apparatus according to claim 6, wherein the control unit generates the cleaning start signal in a case where the counted number of times is larger than a predetermined number of times.

8. The image forming apparatus according to claim 6, wherein, regarding a number of times the apparatus performs an image forming operation to form an image on a sheet, the control unit generates the next cleaning start signal in response to the number of times exceeding a predetermined number of times, wherein counting of the number of times by the counter unit has started after movement of the holding member from the first area to the second area in response to the cleaning start signal.

9. The image forming apparatus according to claim 1, further comprising an operation unit configured to accept an instruction from an operator.

10. The image forming apparatus according to claim 9, wherein the control unit generates the cleaning start signal based on the instruction accepted at an arbitrary timing from the operator through the operation unit.

11. The image forming apparatus according to claim 1, further comprising:

a contact member with which the holding member to be moved either in the first direction, in which the holding member moves from the first area toward the second area, or in the second direction, which is opposite of the first direction, comes into contact at the first area or the second area.

12. The image forming apparatus according to claim 11, further comprising:

a drive motor configured to drive the movement unit, a drive current flowing in the drive motor being to vary in a case where the holding member comes into contact with the contact member.

13. The image forming apparatus according to claim 12, further comprising:

an electric current detection unit configured to detect the drive current of the drive motor.

14. The image forming apparatus according to claim 13, wherein the control unit stops driving of the movement unit in a case where a result of detection performed by the electric current detection unit exceeds a predetermined value.

15. The image forming apparatus according to claim 11, wherein the holding member moving in the direction from the first area toward the second area comes into contact with the contact member after the cleaning member moves outside the light passing area in a rotational axis direction.

* * * * *